US005852799A

United States Patent [19]

Flomen et al.

[11] Patent Number: 5,852,799

[45] Date of Patent: Dec. 22, 1998

[54] PITCH DETERMINATION USING LOW TIME RESOLUTION INPUT SIGNALS

[75] Inventors: Felix Flomen, Rishon Lezion; Leon Bialik, Or Yehuda, both of Israel

[73] Assignee: AudioCodes Ltd., Or Yehuda, Israel

[21] Appl. No.: 731,391

[22] Filed: Oct. 18, 1996

[30] Foreign Application Priority Data

Oct. 19, 1995 [IL] Israel ..... 115697

[51] Int. Cl.[6] ..... G10L 9/08

[52] U.S. Cl. ..... 704/207; 704/212; 704/500

[58] Field of Search ..... 704/207, 200, 704/201, 205, 211, 216, 265, 503, 209, 217, 218, 212, 278, 500

[56] References Cited

U.S. PATENT DOCUMENTS

| | | | |
|---|---|---|---|
| 4,401,850 | 8/1983 | Harbeson | 704/207 |
| 4,486,900 | 12/1984 | Cox et al. | 704/207 |
| 4,935,963 | 6/1990 | Jain | 704/207 |
| 5,003,604 | 3/1991 | Okazaki | 704/207 |
| 5,313,553 | 5/1994 | Laurent | 704/207 |

OTHER PUBLICATIONS

Article entitled: "Advances in Speech Coding" by Bishnu S. Atal, Vladimir Cuperman, and Allen Gersho, copyright 1991 by Kluwer Academic Publishers, Second Printing, 1994.

*Primary Examiner*—David R. Hudspeth
*Assistant Examiner*—Donald L. Storm
*Attorney, Agent, or Firm*—Skjerven, Morrill, MacPherson, Franklin & Friel LLP

[57] ABSTRACT

A pitch determination device which separates at least each frame of the input speech signal into separate, lower resolution portions is provided. The pitch determination device includes a resolution lowering unit, a signal selecting unit and a pitch determination device. The resolution lowering unit has an input line on which the input speech signal is provided and K output lines, on each of which output lines, one of K lower resolution input signals is provided. The signal selecting unit has K input lines connected to the K output lines of the resolution lowering unit and has an output line on which is provided one of the K lower resolution signals which fulfill a predetermined quality criterion. The criterion is typically based on the energy content of the lower resolution signals. The pitch determination device has an input line connected to the output line of the signal selecting unit and an output line which provides a pitch value for the selected lower resolution input signal. The lower resolution signals are subsampled by K, where each ith lower resolution signal is offset from said input signal by i sample points, where i varies from 0 to K−1. The pitch determination is performed by cross-correlating or autocorrelating between two low resolution signals, that of the input signal and of a shifted and offset lower resolution signal. For cross-correlation, the shifted lower resolution signal is a previously received signal. For autocorrelation, the shifted lower resolution signal is a shifted version of the low resolution input signal.

14 Claims, 3 Drawing Sheets

PITCH DETERMINATION USING LOW TIME RESOLUTION INPUT SIGNALS

FIELD OF THE INVENTION

The present invention relates to speech processing systems in general and to pitch value determination systems in particular.

BACKGROUND OF THE INVENTION

Pitch determination devices are known in the art. They form a significant portion of any speech processing system and, accordingly, there are many different types of devices. For each type of device, the input speech signal is divided into frames and the pitch determination performed per frame.

FIG. 1 illustrates an exemplary prior art pitch determination device, for use within a vocoder, a speaker identification system or any other speech processing system which is based on correlation techniques. The device of FIG. 1 includes a buffer 10 which stores the present frame (of the input speech signal) and a buffer 12 which stores data from the recent past. It also includes a pitch determiner 13 formed of a correlator 14 and a pitch selector 16. Correlator 14 performs a cross-correlation between the frame of the input speech signal, stored in frame buffer 10, and frame-sized speech signals from the recent past, stored in frame buffer 12. Correlator 13 provides the correlation results to pitch selector 16 which selects the pitch estimate to be the offset providing the largest cross-correlation result. In some systems, the pitch estimate is then provided to a post-processor 18 which refines the pitch estimate.

The article "Efficient Encoding of the Long-Term Predictor in Vector Excitation Coders", by Mei Yong and Allen Gersho, and found in the book, *Advances in Speech Coding,* edited by B. S. Atal, V. Cuperman and A. Gersho, Kluwer Academic Publishers, 1994, pp. 329–338, details a pitch determiner such as is shown in FIG. 1 for use in a vocoder. The article "Pitch and Voicing Determination" by Wolfgang Hess, *Advances in Speech Signal Processing,* edited by S. Furui, and M. M. Sondhi, Marcel Dekker Inc., 1992, pp. 3–41, illustrates many types of pitch determination systems, such as those which utilize correlation techniques, frequency domain analysis and maximum likelihood techniques. The two articles are incorporated herein by reference.

SUMMARY OF THE PRESENT INVENTION

It is an object of the present invention to provide reduced complexity pitch determination devices. Applicants have realized that the pitch determination process is computation-intensive. The present invention seeks to reduce the computation without significantly affecting the quality of the compressed speech.

There is therefore provided, in accordance with a preferred embodiment of the present invention, a pitch determination device which separates at least each frame of the input speech signal into separate, lower resolution portions. For example, the portions can be subsampled by K wherein each portion has every K samples of the original frame and there are K portions or the portions can have M of every N (such as two out of three) samples. The pitch determination device first determines which portion is the most likely to have significant speech information therein, typically through measurement of the energy in the speech signal. Standard pitch determination operations, such as the cross-correlation described hereinabove or other operations, are then performed on the selected portion and, if the pitch determination utilizes past data, on corresponding portions of signals from the recent past. The pitch distance providing the largest correlation value is selected as the pitch value.

If desired, the pitch value can be provided to a post-processor for refining of the pitch value. This operation is often a cross-correlation typically performed on the complete input frame with a plurality of complete frames of the past beginning at sample points slightly before and after the sample point having the pitch value determined by the pitch determination device of the present invention.

There is therefore provided, in accordance with a preferred embodiment of the present invention, a method and device for determining the pitch of an input signal. The method includes the steps of a) separating the input signal into K lower resolution input signals, b) selecting one of the K lower resolution input signals for processing, in accordance with a predetermined quality criterion, and c) performing pitch determination utilizing at least the selected lower resolution input signal.

Additionally, in accordance with a preferred embodiment of the present invention, the predetermined quality criterion is the amount of energy in each of the K lower resolution input signals.

Moreover, the pitch determination includes the steps of a) generating at least one lower resolution input signal of a previous signal, beginning at L sample points prior to the beginning of the input signal and corresponding to the selected lower resolution input signal, b) cross-correlating the selected lower resolution input signal with said previous lower resolution signals, for various values of L, c) determining the quality of the cross-correlation for each value of L, and d) selecting the value of L which provides the best quality level in accordance with a predetermined criterion.

Alternatively, the pitch determination includes the steps of a) autocorrelating the selected lower resolution input signal with versions of itself shifted earlier by L, for various values of L, b) determining the quality of the autocorrelation for each value of L and c) selecting the value of L which provides the best quality level in accordance with a predetermined criterion.

Furthermore, in accordance with a preferred embodiment of the present invention, the input signal is a speech signal which has been processed by a processor selected from the group of: an inverse or whitening filter, a perceptually weighting filter, a non-linear processor, such as a central clipping processor.

Still further, the lower resolution signals are subsampled by K, where each lower resolution signal is offset from its corresponding signal by an amount Q. Alternatively, they are signals having M of every N samples.

BRIEF DESCRIPTION OF THE DRAWINGS

The present invention will be understood and appreciated more fully from the following detailed description taken in conjunction with the drawings in which.

DETAILED DESCRIPTION OF PREFERRED EMBODIMENTS

The present invention is a pitch determination device which separates each frame, of at least the input signal, into portions. The input signal can be any suitable signal having speech therein, such as one which has passed through an inverse or whitening filter, a perceptually weighting filter or a non-linear processor, such as one which performs central clipping. Furthermore, the pitch determination device of the present invention can be implemented in any speech processing unit which performs pitch determination, such as for a vocoder, a speaker identification system or a biomedical diagnosis system based on speech analysis.

The frames can be subsampled by K wherein each portion has every K samples of the original frame and there are K portions or the portions can have M of every N (such as two out of three) samples. The present discussion and the drawings concentrate on the embodiment where the portions are obtained by subsampling; it will be understood that the invention incorporates other forms of separating the input signal into lower resolution portions.

The pitch determination device first determines which portion, of the input speech signal, is the most likely to have significant speech information therein, typically through measurement of the energy in the speech signal. Standard pitch determination operations, such as the cross-correlation described hereinabove or other operations, are then performed on the selected portion.

Figure 1:
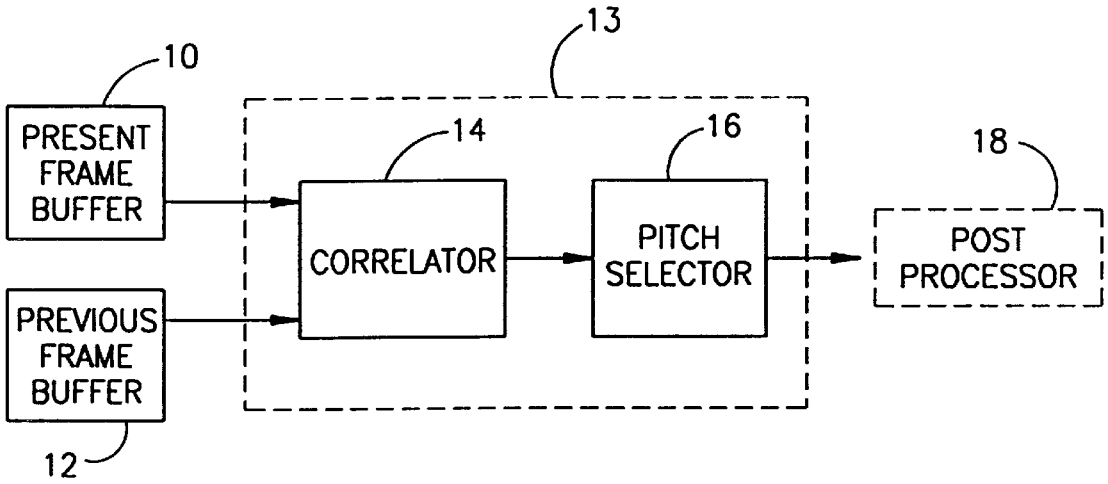
FIG. 1 PRIOR ART
FIG. 1 is a block diagram illustration of a prior art pitch determination device.
Figure 2:
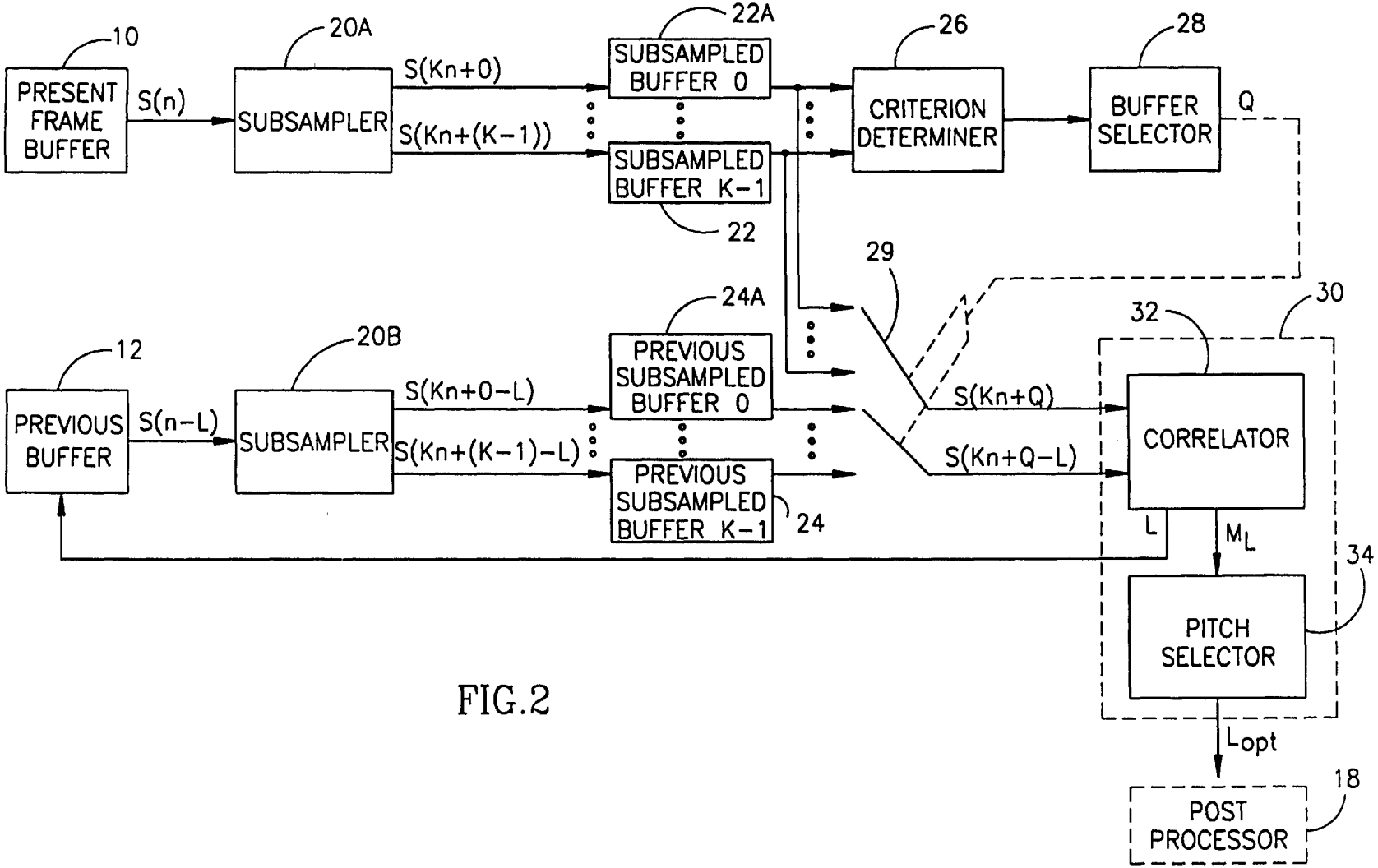
FIG. 2 is a block diagram illustration of a pitch determination device, constructed and operative in accordance with a first preferred embodiment of the present invention.

Reference is now made to FIG. 2 which illustrates one preferred embodiment of a pitch determination device of the present invention. The pitch determination device comprises the present and previous buffers 10 and 12, as in the prior art, two subsamplers 20 for producing K subsampled signals, K subsampled buffers 22 for storing the K subsampled versions of the input signal s(n) and K previous subsampled buffers 24 for storing the K subsampled versions of previously received signals L sample points prior to s(n) (e.g. s(n−L)), a criterion determiner 26, a buffer selector 28, a logical buffer switch 29 and a pitch determiner 30. The output of pitch determiner 30 can, optionally, be provided to post-processor 18. For signals sampled at 8 KHz, L varies from 17 to 145. FIG. 2 also shows optional preprocessors 8 which preprocess the signal as discussed hereinabove.

In accordance with the present invention, the subsamplers 20 subsample their input signals and produce K subsampled signals. Thus, subsampler 20*a* converts the input signal s(n) (whose pitch value is unknown) to K subsampled signals s(Kn+i), where i varies from 0 to K−1. The subsampling consists of selecting every Kth sample point, starting from the ith sample point. Subsampler 20*b* operates similarly, but on data from the previous buffer 12 which is L sample points prior to each point in the input signal s(n). The value of L, being the currently unknown pitch distance, is controlled by pitch determiner 30.

The buffers 22 and 24 can be any appropriate form for storing the data, as necessary for the particular implementation. The present invention also incorporates devices which maintain the subsampled signals in any suitable form, whether or not the data is formally stored.

In accordance with the present invention, pitch determiner 30 operates on only one pair of subsampled signals, one corresponding to the input signal and one corresponding to the prior signal. The amount of calculations which pitch determiner 30 must do is a function only of how long the subsampled signal is. Thus, the larger K is, the fewer operations which pitch determiner 30 must have. On the other hand, if there are not enough samples in the subsampled signal, the output of pitch determiner 30 will be of low quality. A typical value for K is two or three.

Criterion determiner 26 determines the value of a criterion whose purpose is to indicate which of the subsampled signals is "best" for performing the pitch determination. For example, the criterion can be the amount of energy $F_i$ in each portion i, as defined in equation 1.

$$F_i = \sum_{n=0}^{\lfloor (N-1)/K \rfloor} s^2(Kn+i) \tag{1}$$

where N is the number of sample points in the original, non-subsampled frame. Typically, N is 100–256 for signals sampled at 8 KHz.

Buffer selector 28 selects the subsampled signal whose criterion is "best". Thus, for the example provided hereinabove, buffer selector 28 selects the subsampled signal having the most energy. On output, buffer selector 28 indicates to buffer switch 29 to select the Qth pair of subsampled buffers 22 and 24, where Q is the value of i corresponding to the signal with the largest energy. Thus, if the subsampled signal s(Kn−0) had the most energy, then buffer switch 29 would select the output of the subsampled buffers 22*a* and 24*a*.

The signals selected by buffer switch 29 are provided to pitch determiner 30 who determines the pitch distance value L by which the previous signal s(Kn+Q−L) matches the subsampled input signal s(Kn+i). The pitch determiner 30 can be any suitable pitch determiner.

It will be appreciated that the present invention only utilizes one pair of subsampled signals out of the set of subsampled signals for the pitch determination operation. Thus, the pitch determination of the present invention performs 1/K of the calculation operations as the prior art pitch determination.

In one embodiment, shown in FIG. 2, pitch determiner 30 comprises a correlator 32 and a pitch selector 34. Correlator 32 selects a range of pitch values L and, for each one, correlates the subsampled input signal s(Kn+Q) with the subsampled prior signal s(Kn+Q−L). Correlator 32 provides a correlation metric $M_L$ for each value of L, indicating the quality of the match for that value of the pitch distance. Pitch selector 34 selects the output pitch value $L_{opt}$ as the pitch value L for which the correlation metric $M_L$ indicates the closest match.

The correlation operation has to minimize the following term:

$$E = \sum_{n=0}^{\lfloor (N-1)/K \rfloor} ((s(Kn+Q) - \beta s(Kn+Q-L))^2 \tag{2}$$

To find the minimum value of E, equation 2 has to be differentiated with respect to β. Thus, $\beta_{min}$ min for the minimum value of E is:

$$B_{min} = \frac{\sum_{n=0}^{\lfloor (N-1)/K \rfloor} s(Kn+Q)s(Kn+Q-L)}{\sum_{n=0}^{\lfloor (N-1)/K \rfloor} s^2(Kn+Q-L)} \tag{3}$$

Replacing $\beta_{min}$ into equation 2 provides us with the correlation metric $M_L$, as follows:

$$M_L = \frac{c^2}{d} = \frac{\left( \sum_{n=0}^{\lfloor (N-1)/K \rfloor} s(Kn+Q)s(Kn+Q-L) \right)^2}{\sum_{n=0}^{\lfloor (N-1)/K \rfloor} s^2(Kn+Q-L)} \tag{4}$$

where $c^2$ is the numerator and d is the denominator of equation 4.

Many other criteria are possible. Two of them are provided in equations 5 and 6, as follows:

$$M_{L'} = \frac{K^2c^2}{\sum_{n=0}^{N-1} s^2(n-L)} \quad (5)$$

$$M_{L'} = \frac{|c|}{d} \quad (6)$$

For equation 5, the denominator utilizes the full signal s(n−L) rather than the subsampled one. Thus, for this embodiment, the correlator 30 also receives data directly from the previous buffer 12.

It will further be appreciated that the output of buffer selector 28 can be provided directly to subsampler 20*b* which, in turn, can directly produce the desired subsampled signal s(Kn+Q−L), without having to store all of the subsampled prior signals s(Kn+Q−L). In this, alternative embodiment, there is only one previous subsampled buffer 24.

It will still further be appreciated that the concepts of the present invention can be implemented in pitch determination devices which do not utilize prior data, such as those described in the article by Wolfgang Hess. Such devices receive only the input signal; they do not receive data from the previous buffer 12.

Figure 3:
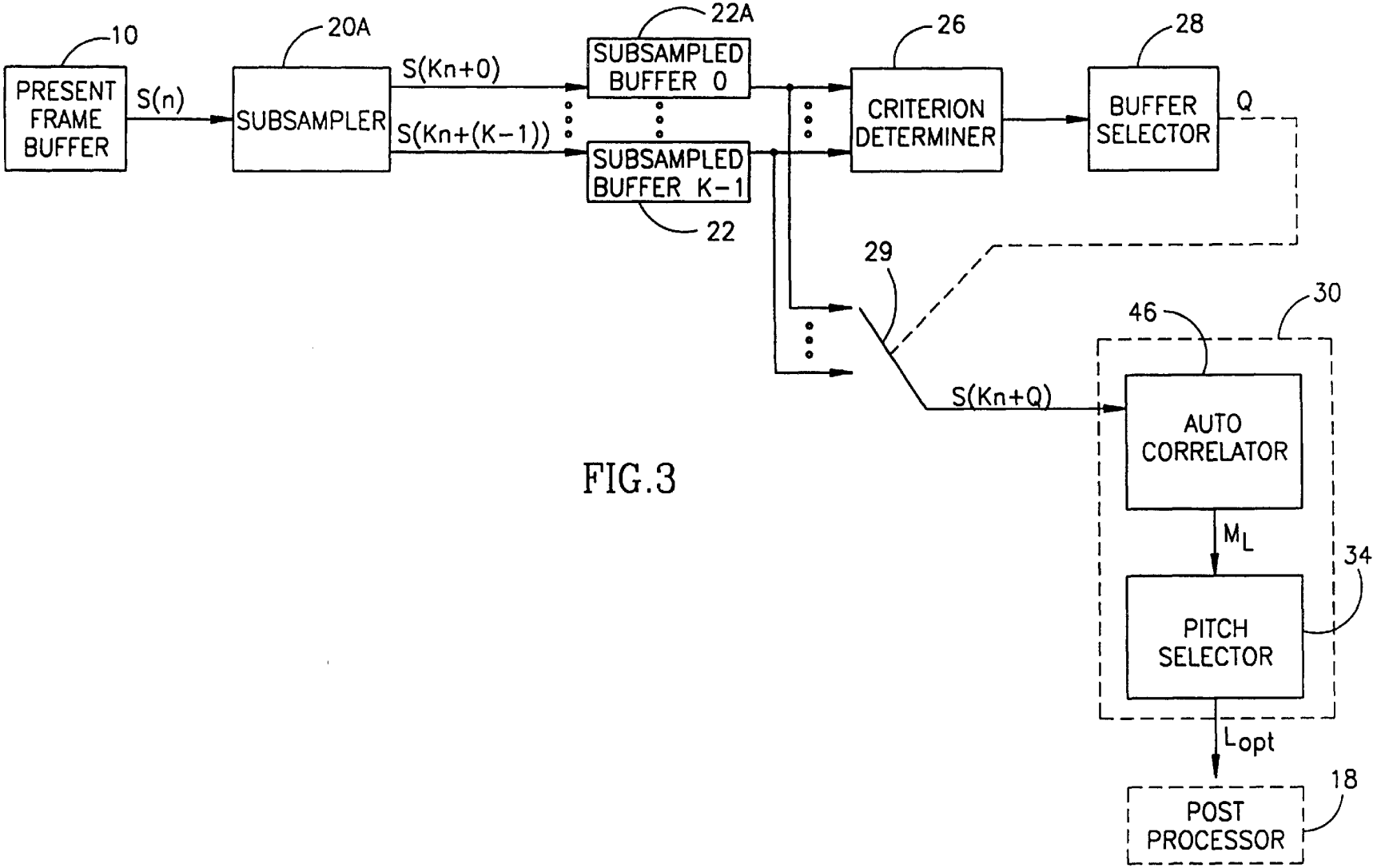
FIG. 3 is a block diagram illustration of a pitch determination device, constructed and operative in accordance with a second preferred embodiment of the present invention.

For example, and as shown in FIG. 3 to which reference is now made, the pitch determination unit can comprise an autocorrelator 46 instead of the correlator 32. In this embodiment, only the subsampler 20*a,* subsampled buffers 22*a,* criterion determiner 26, buffer selector 28 and buffer switch 29 are necessary to prepare the input signal for the autocorrelator 46. In this embodiment, buffer switch 29 selects which of the subsampled buffers 22 to connect to the pitch determination device.

The autocorrelator 46 performs the following operation:

$$E = \sum_{n=0}^{\lfloor ((N-1)-L')/K \rfloor} s(Kn)s(Kn+L') \quad (7)$$

where L' is the pitch distance value which is less than the number N of samples within the input signal s(n).

It will further be appreciated by persons skilled in the art that the present invention is not limited to what has been particularly shown and described hereinabove. Rather the scope of the present invention is defined only by the claims which follow:

We claim:

1. A method for determining the pitch of an input signal, the method comprising the steps of:

a. separating said input signal into K lower resolution input signals;

b. selecting one of said K lower resolution input signals for processing, in accordance with a predetermined quality criterion;

c. performing pitch determination utilizing the selected lower resolution input signal.

2. A method according to claim 1 and wherein said predetermined quality criterion is the amount of energy in each of said K lower resolution input signals.

3. A method according to claim 1 and also including a step of sampling said input signal, wherein said step of performing pitch determination includes the steps of a. generating lower resolution previous signals from previously sampled signals, beginning at L sample points prior to the beginning of the input signal and corresponding to said selected lower resolution input signal;

b. cross-correlating said selected lower resolution input signal with each of said previous lower resolution signals, for various values of L; and c. selecting the value of L which provides the best value of a second predetermined quality criterion based on the cross-correlation results.

4. A method according to claim 1 and also including a step of sampling said input signal, wherein said step of performing pitch determination includes the steps of:

a. auto-correlating said selected lower resolution input signal with sampled versions of itself shifted earlier by L sample points from the beginning of said input signal, for various values of L; and b. selecting the value of L which provides the best value of a second predetermined quality criterion based on the autocorrelation results.

5. A method according to claim 1 and wherein said input signal is a speech signal which has been processed by a processor selected from the group of: an inverse or whitening filter, a perceptually weighting filter and a non-linear processor which performs central clipping.

6. A method according to claim 1 wherein said step of separating includes the step of subsampling said input signal by K to produce said lower resolution signals, where each ith lower resolution signal is offset from said input signal by i sample points, where i varies from 0 to K−1.

7. A method according to claim 1 wherein said step of separating includes the step of subsampling said input signal by selecting M of every group of N samples of said input signal thereby to produce said lower resolution signals.

8. A pitch determination device for determining the pitch of an input speech signal, the device comprising:

a. a resolution lowering unit having an input line on which said input speech signal is provided and having K output lines, wherein, on each output line one of K lower resolution sampled input signals is provided;

b. a signal selecting unit having K input lines connected to said K output lines of said resolution lowering unit and having an output line on which is provided the one of said K lower resolution signals which fulfills a predetermined quality criterion;

c. a pitch determination device having an input line connected to the output line of said signal selecting unit and having an output line which provides a pitch value for said selected lower resolution input signal.

9. A device according to claim 8 and wherein said predetermined quality criterion is the amount of energy in each of said K lower resolution input signals.

10. A device according to claim 8 and wherein said pitch determination device includes:

a. a second resolution lowering unit having an input line on which at least one previous signal, beginning at L sample points prior to the beginning of the input signal, is provided and having at least one output line on which at least one of K previous, sampled lower resolution input signals is provided;

b. a cross-correlator having two input lines connected to the output lines of said signal selecting unit and said second resolution lowering unit and having an output line on which the cross-correlation of said selected lower resolution input signal with each of said previous lower resolution signals, for various values of L, is provided; and c. a pitch selector having an input line connected to the output line of said cross-correlator and an output line on which the value of L for which the cross-correlation has the best value of a second predetermined quality criterion based on the cross-correlation results is provided.

11. A device according to claim 8 and wherein said pitch determination device includes:

a. an autocorrelator having an input line connected to the output line of said signal selecting unit and having an output line on which the autocorrelation of said selected lower resolution input signal with sampled versions of itself shifted earlier by L sample points from the beginning of said input signal, for various values of L, is provided; and b. a pitch selector having an input line connected to the output line of said autocorrelator and an output line on which the value of L for which the autocorrelation has the best value of a second predetermined quality criterion based on the autocorrelation results is provided.

12. A device according to claim 8 and wherein said input signal is a speech signal which has been processed by a processor selected from the group of: an inverse or whitening filter, a perceptually weighting filter and a nonlinear processor which performs central clipping.

13. A device according to claim 8 wherein said lower resolution signals are versions of said input signal subsampled by K, where each ith lower resolution signal is offset from said input signal by i sample points, where i varies from 0 to K−1.

14. A device according to claim 8 wherein said lower resolution signals are versions of said input signal from which M of every group of N samples of said input signal are selected.

* * * * *